United States Patent [19]

Schoennagel et al.

[11] 4,298,453

[45] Nov. 3, 1981

[54] COAL CONVERSION

[75] Inventors: Hans-Juergen Schoennagel, Lawrenceville; John C. Zahner, Princeton, both of N.J.

[73] Assignee: Mobil Oil Corporation, New York, N.Y.

[21] Appl. No.: 864,402

[22] Filed: Dec. 27, 1977

[51] Int. Cl.[3] ..... C10G 1/08; C10G 1/00; C10L 1/00; C10J 3/16

[52] U.S. Cl. ..... 208/10; 208/8 R; 44/1 F; 48/202; 48/197 FM

[58] Field of Search ..... 208/10, 8; 44/1 F; 48/202, 197

[56] References Cited

U.S. PATENT DOCUMENTS

| | | | |
|---|---|---|---|
| 2,436,938 | 3/1948 | Scharmann et al. | 48/202 |
| 2,543,795 | 3/1951 | Mayer et al. | 48/202 |
| 3,847,566 | 11/1974 | Wilson | 48/197 R |
| 3,847,567 | 11/1974 | Kalina et al. | 48/202 |
| 3,890,111 | 6/1975 | Knudsen | 48/197 R |
| 3,890,112 | 6/1975 | Aldridge | 48/197 R |
| 3,891,402 | 6/1975 | Nahas | 48/197 R |
| 3,927,996 | 12/1975 | Knudsen et al. | 48/197 R |
| 3,957,459 | 5/1976 | Mitchell et al. | 48/197 R |
| 3,988,236 | 10/1976 | Albright et al. | 208/8 |
| 3,988,237 | 10/1976 | Davis et al. | 208/8 |
| 3,993,583 | 11/1976 | Seglin | 48/202 |
| 4,046,523 | 9/1977 | Kalina et al. | 48/202 |
| 4,071,432 | 1/1978 | Knell et al. | 208/8 |

*Primary Examiner*—Delbert E. Gantz
*Assistant Examiner*—William G. Wright
*Attorney, Agent, or Firm*—Charles A. Huggett; Michael G. Gilman; Charles J. Speciale

[57] ABSTRACT

A process for the catalytic devolatilization of coal is disclosed wherein a selected mixture of preheated coal particles and hot catalyst solids is contacted with a gaseous material such as steam and/or a hydrogen-containing gas to form a high temperature suspension in a riser reactor to obtain a high initial rate of heat transfer from high temperature catalyst particles to coal particles thereby promoting high yields of devolatilized liquid hydrocarbon product. Morever, the quality of the devolatilized material is improved by the hot catalytic solids which either convert devolatilized tars and phenols to more desirable products or prevent tar and phenol formation by catalytic interception of the initial products devolatilized from the coal. Char produced by this devolatilization technique is particularly suited for subsequent gasification and other use.

25 Claims, 2 Drawing Figures

COAL CONVERSION

BACKGROUND OF THE INVENTION

1. Field of the Invention

This invention relates to an improved coal conversion process and more particularly relates to a process for devolatilizing and gasifying coal.

2. Description of the Prior Art

A variety of methods are known in the art for converting solid coal into normally liquid and normally gaseous hydrocarbons; a number of widely varying processes for carbonization and hydrocarbonization of coal are now available. Temperatures of individual reaction stages vary from 800° to 3000° F. and pressures range from near atmospheric to over 1000 psi. Contacting modes include fixed bed, fluidized bed, and dispersed phase. In any particular reaction stage, the gas-solids contacting mode may be either concurrent, counter-current, or backmixed, with perhaps another mode of contact from stage to stage. The number of reaction stages may vary from a simple, single contact through multiple-bed configurations, to essentially infinite stages in the continuously-variable temperature, fixed-bed gasifiers.

Low-temperature carbonization of coal with by-product recovery of liquids and gases has received growing attention in recent years. In the low temperature carbonization of coal (e.g., from about 750° to 1800° F.), the quantity of gaseous products is small and that of liquid products is relatively large; in the high-temperature carbonization of coal (e.g., at temperatures greater than about 1650° F.), the yield of gaseous products is larger than the yield of liquid products, the production of char being relatively low. During the 1950's, efforts were directed toward production of char for fuel and little attention was given to optimization of tar and oil yields. More recent investigations have led to the concept of hydrocarbonization, wherein the production of coal liquids is emphasized.

Hydrocarbonization processes are similar to low-temperature carbonization in that fluidized or entrained beds are used. However, pressurized hydrogen is used as the fluidizing medium instead of air. Hydrogen tends to increase the yields of liquids, particularly as the hydrogen partial pressure is increased. But the hydrocarbonization processes should be distinguished from high-pressure hydrogenation processes. Although the liquid yields for hydrocarbonization are somewhat lower than for hydrogenation, the overall yields of gas plus liquids are comparable. Moreover, the difficult "pasting" oil recycle and heavy oil letdown problems encountered in hydrogenation processes are avoided with hydrocarbonization.

A process being developed for the very rapid pyrolysis of coal is the Garrett Pyrolysis process described by Sass, "The Garrett Research and Development Co. Process for the Conversion of Coal into Liquid Fuels," presented at the 65th annual A.I.Ch.E. meeting, New York, New York, Nov. 29, 1972. The process is characterized as an entrained-bed, low-temperature carbonization with a short residence time that produces a high yield of liquid fuels. Feed coal is dried, pulverized, and conveyed with recycle product gas to the pyrolysis reactor. In the reactor, the coal is heated to 579° C. (about 1075° F.) by recycled char as the solids are conveyed through the pyrolysis zone at high velocity. The stream then passes through cyclones and a portion of the separated char is cooled and sent to storage. The remaining solids are reheated by partial combustion with air to a temperature of 649° to 871° C. (1200° to 1600° F.) in the char heater which acts as an entrained-bed reactor. Then the reheated solids are reconveyed to the pyrolysis reactor. Gases from the reactor are cooled and scrubbed to collect the product tar. Make-gas may be purified and converted to a marketable pipeline gas or used within the plant as a source of hydrogen. The char is useful as a fuel. The attractiveness of the Garrett process is said to be the high liquid yields obtained at low pressures by the rapid conductive heating of the small coal particles and by the short exposures to the high-temperature reactor, which prevent thermal decomposition of the tars in the reactor. At hydrogen partial pressures near one atmosphere and temperatures of 579° C. to 590° C. liquid yields up to 33 percent were reportedly achieved in the Garrett process.

The Garrett process is essentially the hydrocarbonization process analog of the "transfer line" carbonization process described in U.S. Pat. No. 2,608,526. In the latter process, carbonaceous feed is contacted with a finely-divided, highly turbulent mass of solids preheated to 1000° to 1600° F. in an elongated solids transfer line of relatively small cross section for a time sufficient to carbonize the feed but insufficient to permit appreciable cracking of volatile products. The solids residence time is within the range from about 0.5 to 15 seconds. The heat-carrying solids may be hot coke or inert solids such as sand, clay, etc. (column 3, line 33). The feed is quickly heated in the transfer line carbonizer to a temperature of 850° to 1200° F. and volatile products and char are withdrawn together with the propelling gas (steam, $CO_2$, product gas, or the like).

The volatile products withdrawn from the carbonization process tend to be nearly as complex and refractory as the initial substance (the coal) from which it was distilled. Accordingly, U.S. Pat. No. 3,244,615 suggests the immediate catalytic hydrogenation of coal volatiles produced by destructive distillation of coal (in the presence or absence of hydrogen) over a catalyst comprising Co-Mo on alumina. The catalytic hydrogenation is accomplished by vapor phase surface catalysis of the volatile matter immediately following destructive distillation of the coal in a catalyst chamber separate from the distillation zone. A patent related to U.S. Pat. Nos. 3,244,615 is 3,247,092. Also, see U.S. Pat. No. 3,736,233 which teaches a transfer line coking process employing an iron oxide sulfur acceptor.

Methods for producing gases from coal or coal char are also well known in the art. Currently, there are only three coal gasification processes in commercial operation: (1) Lurgi fixed bed gasifier, (2) Koppers-Totzek entrained gasifier and (3) Winkler fluid bed process. Numerous other gasification schemes such as Bi-Gas, Hygas, etc. have been proposed and are at various stages of development. Only Lurgi recovers the hydrogen-rich volatile fractions from coal as by-products, but these co-products (tars, phenols, naphtha, etc.) are not considered valuable as they cause process complications and downstream handling difficulties. Further, it would appear that for coal gasification schemes in general, large quantities of potentially valuable organic compounds are unnecessarily degraded to gas and char.

Gasification may be envisioned as a sequence of three distinctly different steps:

1. Pyrolytic decomposition of the coal and production of volatile matter (Devolatilization).
2. Interaction of volatile species under reducing conditions to produce gases and char (Reductive Gasification—Recoking).
3. Interaction of coke and char under oxidizing conditions to produce additional gases (Oxidative Gasification).

Presently all three of these steps are conducted in one reactor. See, for example, McCaleb, T. L., and Chen, C. L., "Coal Processing: Low BTU Gas is an Industrial Fuel," *Chemical Engineering Progress,* Volume 73, No. 6, pages 82–88, American Institute of Chemical Engineers (June, 1977).

In conventional pyrolytic processes for producing volatile matter from coal (discussed above), the yields of potential fuels or chemicals are rather low although the recent development of flash pyrolysis processes wherein the coal is rapidly heated results in higher yields of volatile matter. Typical values are 5–25 percent tar, 2–5 percent $H_2$ and hydrocarbon gases, and 0–10 percent carbon oxides. The tar constituents can be separated into various chemicals but such separations are very expensive. Generally, tars are burned to generate the heat for the process which has as its major objective to produce coke. Because the yields of these materials are low in conventional pyrolytic processes, there is relatively little incentive to develop a large-scale conversion of coal for their production.

Gasification as presently practiced involves during the initial stages a pyrolysis very similar to that described above with the resultant char being gasified through partial oxidation of the solid. The initially volatilized materials are also converted to gases in a homogeneous gas phase reaction. This gas phase reaction, although faster than gas-solid reactions, is less efficient as the volatiles are released near the entry of the coal and often near the exit of the product gases. The yield of tar of this type is a detriment to the overall process for two reasons: (1) it is admixed with large quantities of water and thus phenolic materials occur in highly diluted aqueous phases and (2) it can cause plugging or corrosion of reactors and lines. The polymerization (recoking of tar) is accentuated by oxygen. Thus coking of tar occurs in the gasifier. This coke is of lower surface area and therefore of lower reactivity than residual coke from the devolatilized coal.

This recoking of tar has been recently shown to be much more important than previously suspected. D. B. Anthony (AIChE Journal 22 622 (1976)) has reviewed extensively the problems of coal devolatilization and shown quite conclusively that by rapidly heating coal and quenching the products, much higher yields of volatile products are possible. The major cause for this increased yield is due to increased tar formation.

The exact chemical nature of the tar is not known. However, it is known that the selectivity of the tar-char reaction can be dramatically affected by the presence of solid materials. In inert atmospheres it is believed that solid surfaces promote the recoking of the tar on the solid surfaces. However, in the presence of reaction gases, solid surfaces can promote favorable gasification reactions.

Hydrogen is one reaction gas that has been studied extensively. Rapid heating of coal in hydrogen atmospheres can result in well over 50 percent volatile yields. In the presence of solid catalysts, volatile yields as high as 90 percent have been reported (the majority of which occurs in less than 1 second). The primary products of gasification in the presence of $H_2$ is $CH_4$. However, other heavier products are also accentuated. It is believed that the initial step in this overall scheme is the devolatilization of the coal to small reactive fragments. These can either recombine or react with other species such as $H_2$.

After the relatively fast reactions of devolatilization, reductive gasification and recoking, the residual solid material (coke) is then gasified under oxidative conditions. This generally is carried out in the lower regions of present gasifiers by direct combustion with oxygen (partial and/or complete). An intermediate gasification of char also occurs due to the interaction of char with hot CO, $CO_2$, and steam. This intermediate stage is the predominant reaction which leads to the production of CO and $H_2$.

An object of the present invention is to provide a coal devolatilizing and conversion process wherein more desirable volatile product fractions of the coal are efficiently recovered.

Another object of this invention is to provide a more desirable environment for char formation during coal devolatilization which will provide a coal char highly desirable for subsequent use including gasification. A further object of this invention is to provide a coal devolatilizing process which improves the direct production of premium liquid hydrocarbon products. A further object of this invention is to furnish a unique method for ash removal.

SUMMARY OF THE INVENTION

The objects above identified are achieved by the process of the present invention substantially by first subjecting preheated pulverized coal to a high temperature (above 750° F.) distillation or devolatilization thereof in the presence of heat-contributing, conversion catalyst solids to form volatiles and char. The char thus produced is separated from the volatiles and all or a portion of the separated char may then be gasified in a separate vessel. The process of this invention combines the steps of coal devolatilization and catalytic conversion to lower boiling volatiles as well as reductive gasification, and char formation in one stage, with the recovery of char and oxidative gasification or other use thereof effected in separate downstream stages. According to the process of this invention, the coal in a pulverized condition is preheated up to about 600° F. (generally within the range from about 100° to 600° F.) and then further heated in a riser-type contact zone by contacting the preheated coal with a relatively large amount of hot catalytic solids at a temperature in the range of 1300° to 1800° F. in admixture with moisture from the coal, added steam and/or hydrogen-rich gas or flue gas to form a suspension with the combined solids and flow upwardly through the riser contact zone. Ratios of solid catalyst particles to coal particles in the riser may be varied considerably but generally are within the range from 0.5:1 to 5:1. The coal particle devolatilizing residence time varies with temperature and particle size and generally is within the range from 2 to 30 seconds. By intimate contact between the hot catalyst and coal solids in the suspension-forming transport gas, the coal particles are rapidly heated to a temperature within the range of 750° F. to 1650° F. and are devolatilized. The yield of the volatiles thus produced is superior to devolatilization processes wherein coal is heated more slowly and the quality of the volatiles is improved by the presence of the catalyst. The large amount of hot catalytic solids in admixture with coal solids provides immediately adjacent reaction sites for improving the quality of the material evolved such as tars and phenols by converting these materials to more desirable products. Preventing tar and phenol formation by catalytic interception of the initial products devolatilized from the coal is particularly promoted by the hot catalyst solids present. The volatiles and gaseous material comprising the suspension are separated from the solids and a coal char residue with or without catalyst solids is gasified or otherwise used as will be hereinafter described in more detail.

The materials passing from the catalytic devolatilization step are easily separated into two or more different components in suitable separation means. The separated components may consist of: (1) a gaseous fraction comprising evolved coal products and suspension-forming transport gas and a solid fraction comprising char and catalyst; (2) a gaseous fraction as described above, a first solids fraction comprising char, and a second solids fraction comprising catalyst; or (3) the components substantially as described in (2) wherein the first and second solids fractions contain varying amounts of catalyst and char, respectively. Generally, the separation effected will be governed by the subsequent processing of the solids fraction of the catalytic devolatilization step effluent.

Depending on the type of coal being devolatilized and on the products desired, any one of a number of different apparatus arrangements may be employed for the catalytic devolatilization and separation steps of the process of this invention. As will become more apparent in the following detailed description of this invention, the reactor and separation systems used to carry out this process are not always discrete (that is, made up of separate and distinct parts). Broadly, any of the range of FCC-type reactors used in the art of petroleum refining may be employed in the process of this invention: e.g., straight riser-cyclone arrangements; riser-dense bed arrangements; riser and cone arrangements (with or without cyclones); or riser cone, dense bed arrangements. Characteristics common to all of these arrangements are that they provide an entrained bed of solids in at least the lower portion of the reactor/separation apparatus and provide a density- (or size-) related separation means at the upper portion of the apparatus. Apparatus other than these referred to above may be employed so long as they have these characteristics.

The process of this invention is extremely versatile in terms of the subsequent treatment of the separated solids component(s) recovered from the separation means. The options available include:

(1) reacting a solids fraction comprising char and catalyst with an oxygen-containing gas and steam in a regenerator/gasifier to produce synthesis gas and hot, regenerated catalyst which is recycled to the catalytic devolatilization zone;

(2) reacting a first solids fraction comprising char with an oxygen-containing gas and steam in a gasifier to produce synthesis gas and separately reacting a second solids fraction comprising catalyst with an oxygen-containing gas to regenerate the catalyst; and (3) combusting (either partially or completely) a solids fraction selected from the group comprising:
(a) char and catalyst or
(b) char
to generate steam and/or to produce a CO-rich stream which may subsequently be converted to synthesis gas by the water-gas shift reaction.

Other options or combinations of options will be obvious to one skilled in the art and are not excluded from the scope of this invention.

Compared to known carbonization or hydrocarbonization processes—especially the very rapid or flash carbonization systems such as the Garrett process described above—the process of this invention differs in part by the addition of hot catalyst solids to the carbonization zone. Accordingly, this invention process maximizes liquid yields by a reaction mechanism which may or may not include some hydrogenation of the normally liquid volatiles evolved from the coal in the riser contact zone but which, at the same time, minimizes thermal decomposition of the volatiles evolved by the very short particle residence time in the reactor. Unlike the Garrett process and other known carbonization processes, however, the addition of hot catalyst solids according to the present invention improves the quality of the devolatilized material either by converting evolved tars and phenols to more desirable, normally liquid products or by preventing tar and phenol formation through catalytic interception of the initial volatiles evolved from the coal.

The steps of catalytic coal devolatilization and volatiles separation performed according to the process of this invention can be very advantageously combined with a subsequent step comprising char gasification. Unlike known coal gasification processes, the process combination afforded by the present invention does not require one to gasify all of the char or to completely gasify and devolatilize coal in a single step. Rather, coal is subjected to a first treatment stage characterized herein as "catalytic devolatilization," wherein coal is pyrolytically decomposed to produce volatile matter and the volatile matter interacts under reducing conditions to produce gases, liquid and char. In a second, separation stage the char and/or coke thus formed is separated from the product gases and liquids and from suspension-forming transport gas. Optionally, a further separation of all or a part of the char from the catalyst solids may be effected. Then, in a third stage, the char and/or coke thus formed and separated is processed under oxidizing conditions to produce additional gases (i.e., oxidative gasification).

The char gasification step of the foregoing process is performed in a manner which is similar to known gasification processes. However, the gasification step of this process combination employs the char product of the particular catalytic devolatilization step of this invention, which char product is advantageously employed for the production of a high-grade synthesis gas—particularly when char is passed with the catalyst particles from the coal devolatilization operation to the char gasification zone. The reactivity of the coal residue or char is affected by the manner in which the coal is devolatilized. Therefore, an important aspect of the coal devolatilization step of the present invention is that it offers a unique and highly-desirable environment for char formation: the riser mixer provides a controlled but rapid temperature rise in the pulverized coal particle upon admixture with hot catalyst particles followed by passing the mixture with gaseous material through a reactor arrangement producing more desirable volatile products and char product.

DESCRIPTION OF THE PREFERRED EMBODIMENTS

Figure 1:
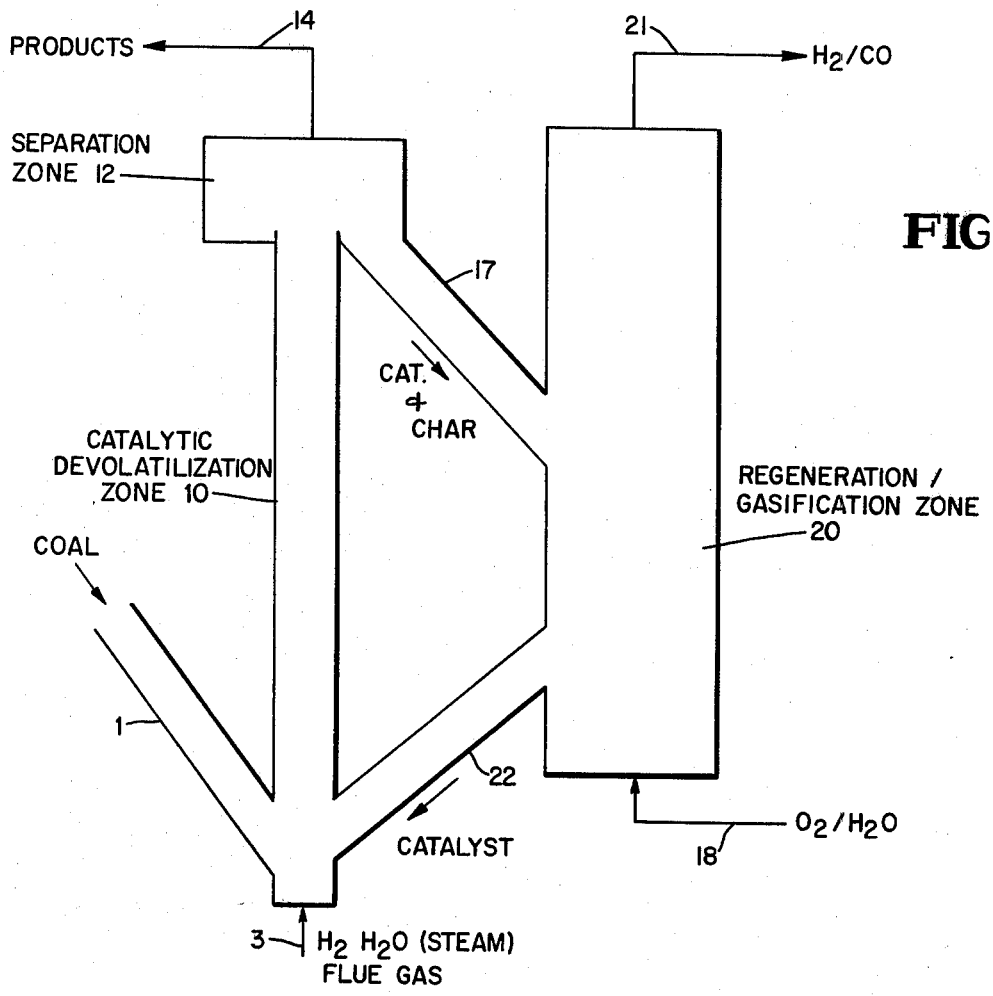
FIG. 1 is a schematic representation of a preferred embodiment of the process of this invention.

The art recognizes two distinct time-temperature regimes in coal gasification: the relatively low temperature devolatilization regime (400°-600° C.) (752°-1112° F.) in which coal ejects a hydrogen-rich assortment of gases, oils, and tars and the relatively high temperature regime (600°-1200° C.) (1112°-2192° F.) in which the remaining carbon skeleton, referred to as char, is processed by partial combustion to develop heat and flue gas and/or by the steam-carbon reaction to yield a mixture of carbon monoxide and hydrogen, commonly referred to as "synthesis gas". A sizeable fraction of a coal feed (about 10 weight percent) can readily be recovered in the form of "liquid hydrocarbons". These products are advantageously collected and processed separately. Heating the coal to cause a much more rapid temperature rise in the coal particles produces a considerably larger fraction of volatiles than obtained at slower temperature rises. Therefore, a rapid, high-temperature, high-heat-transfer process with rapid separation of released volatiles is most desirable. Furthermore, if hydrogen is used in the devolatilization step (hydrocarbonization), an even larger portion of the coal can be converted to more desirable liquid and gaseous hydrocarbon products employing the processing concepts of this invention. For example, methane obtained by such a process is less expensive than that obtained by the hydrogasification of the less reactive char—principally because less severe operating conditions are needed. Accordingly, a large amount of conversion is done while the coal is in the reactive state, that is, upon initial heating when volatiles are ejected and before the carbon skeleton is reshaped and stabilized to form less reactive char.

The catalytic devolatilization step of the process of the present invention employs a combination of techniques to maximize coal conversion to high-quality products in the relatively low temperature range of about 750° F. to about 1650° F:

(1) rapid heating of coal particles with heated catalytic solids and suspension-forming gases in a riser mixing zone, (2) suspension of the hot coal-catalyst particle mixture in a desired velocity gas stream (i.e., 2-50 ft/sec), (3) providing a coal-catalyst mixture residence time sufficient to separate volatiles from coal particles and effect conversion thereof, and (4) catalytic treating (preferably catalytic hydrogenation, as when hydrogen or synthesis gas is employed as the solid particle fluidizing or transport medium) of coal volatiles.

The combination process of this invention is to be distinguished from known processes such as that described in U.S. Pat. No. 3,244,615 (see Discussion of the Prior Art, supra) since the present process admixes the finely divided hot solid catalyst particles with the finely divided coal particles in a high temperature heat exchange environment. Unlike dense particle phase fluidized carbonization or gasification processes, the flow of coal-catalyst and gaseous reactant is initially primarily a continuous plug flow system with little, if any, back mixing. This initial plug flow devolatilization technique coupled with catalytic conversion of volatiles further enhances more desirable volatiles production. Moreover, agglomerating tendencies of the finely divided feed coal are minimized by dispersing or admixing the coal particles with a relatively large amount of solid catalyst particles. The catalyst solids catalytically convert evolved tars and pitches rapidly at the suspension temperature to easier-to-handle volatile materials.

Catalyst solids suitable for use with coal particles in the devolatilization step may be of several types: acid catalysts, both amorphous and crystalline, accentuate the cracking reaction and to some extent the hydrogen transfer reactions depending on the acid catalyst employed; hydrogenation/dehydrogenation metals promote hydrogenation and/or hydrogenolysis of volatiles derived from the coal. The mixed particle surfaces also act as a recipient for recoked tar in a high surface area form. Thus catalyst and char particles accumulate coke. Solid catalyst particles suitable for use in the method and process of the present invention include a variety of acidic materials having active cracking properties relative to tars and phenols evolved at the low-temperature carbonization conditions, such as acid-treated clays, silica-alumina, silica-magnesia, silica-alumina-zirconia, boria-alumina synthetic catalysts and large pore aluminosilicates such as mordenite and faujasite zeolites. For example, the catalyst may be a relatively low activity material such as a used amorphous or crystalline zeolite silica-alumina catalyst. "Used silica-alumina catalyst" is intended to include an equilibrium catalyst having an activity index of about 65 or less. Although metals or metal oxides may be associated with the catalysts, the catalyst particles will normally accumulate metallic oxides such as Fe, Ca, Mg, and Ti oxides from the coal ash during the catalytic devolatilization step.

Depending on the type of coal being devolatilized and on the products desired, any one of a number of different reactor systems or apparatus arrangements may be employed to devolatilize the coal and separate evolved products and suspension-forming transport gas from the remaining solids. For example, it is contemplated employing a tubular pipe, generally vertically positioned, for at least the initial portion of the contact zone wherein mixing of pulverized coal particles with solid catalyst particles is effected in the presence of a suspension forming gaseous material as herein provided. The vertically positioned tubular pipe referred to in the fluid cracking art as a riser reactor may be sufficiently elongated to provide a desired coal particle residence time before separation from volatile material or the pipe may serve only as an initial mixing zone before discharge into the lower portion of an expanded fluid mass of particles and referred to as a dense fluid mass of particles. On the other hand, the elongated tubular riser reactor may discharge into cyclone separators in parallel and/or sequential arrangement to separate solids from gasiform material such as volatiles and gaseous material comprising the suspension. In yet another embodiment, it is contemplated employing a tubular riser contact zone expanded adjacent the discharge end thereof to reduce the velocity of the suspension before discharge into a larger solids separation and collection zone and before gasiform components of the suspension pass through cyclonic separation equipment for removal of entrained solids therefrom. A further embodiment contemplates using a riser contact zone generally diverging from the bottom to the top thereof and resembling an elongated cone. The upper end of this conical contact zone may discharge into the lower or upper portion of a solid collection zone wherein a separation is made between volatile and gaseous materials herein referred to as gasiform material from solid particle material comprising particles of char and solid catalyst particles. In yet another embodiment, it is contemplated passing the suspension recovered from a riser contact zone after achieving a desired coal particles residence time sufficient to form particles of char through a separation arrangement which will separate solid catalyst particles from char and gasiform material and thereafter the gasiform material is separated from entrained char particles. On the other hand, the gasiform material may be separated from the char and catalyst particles and then all or a portion of the particles of char is separated from the catalyst particles.

In any of the arrangements above discussed, it is important to choose and use a particle size of catalyst and pulverized coal which is compatible with effecting the rapid heat exchange desired and ultimate separation of char and catalyst particles. Thus it is desirable to employ pulverized coal less than 8 mesh size and catalyst particles in a fluidizable particle size range within the range of 8 to 400 mesh size. When separation of char and catalyst particles is to be effected, it is contemplated using a catalyst particle size generally larger than the pulverized coal particle so that the separation can be readily obtained as by elutriation in suitable equipment or achieved in substantial measure in a dense fluid bed of the particles. For example, the catalyst particle size distribution should be such that about 90 percent of the particles are larger than about 60 mesh and the char particle size distribution should be such that about 90 percent of the particles are smaller than about 60 mesh.

Referring now to FIG. 1 which is a schematic representation in elevation of a preferred embodiment of the process combination of this invention, particulate or pulverized coal (preferably having a particle size less than about 8 mesh), preheated to a temperature within the range from about 100° to 600° F. (preferably about 200° F.), is fed through line 1 to a riser-reactor 10 for admixture and contact with a large amount of hot, solid catalyst particles introduced by line 22 at a temperature within the range of from about 1300° to about 1800° F. to rapidly heat the coal particles to a temperature within the range from about 750° F. to 1650° F., preferably from about 750° F. to 1200° F., and even more preferably from about 800° F. to 1100° F. A temperature rise in the coal particles of about 600° C. per second is desirable. A sufficient quantity of fluidizing or transporting gas also enters riser 10 through line 3 to transport the hot mixture, preferably in plug flow arrangement, upwardly through the riser. Catalyst-to-coal ratios can be varied considerably to suit the type of coal charged and temperature of the processing conditions but the ratio is sufficient to obtain rapid heat exchange and rapid devolatilization of the coal. The catalyst-to-coal ratio may be within the range from about 0.5:1 to 5:1. The dilution of coal particles by catalyst particles of similar mesh size distribution range minimizes coal particle-to-coal particle interaction, thereby reducing caking problems. The suspension-forming transport gas may be water in the form of steam, hot flue gas obtained from burning char and/or regenerating the catalyst, a hydrogen-containing gas, or mixtures thereof. As an example of a hydrogen-containing gas, synthesis gas may be used to form the suspension and this synthesis gas may be obtained in the process combination as a product of the process as herein discussed. Preferably, hydrogen-rich gas is a part of the suspension in the riser and the hydrogen content of the hydrogen-rich gas is sufficient to aid in the hydrocarbonization of the coal. The hydrogen pressure is at least 20 psig but less than about 500 psig, preferably less than 250 psig. Compared to known hydrogasification processes, both the temperature in the riser mixer reactor (about 1000° F.) and the hydrogen pressure are low. Nevertheless, approximately 10–30 percent or more of the coal is converted to desirable products. The hot active catalyst particles convert the tars and phenols evolved to desirable products or prevents tar and phenol formation by catalytic interception of the initial products evolved from the coal. The temperature rise of the coal particles admixed with hot catalyst particles in the riser mixer is very rapid—desirably about 600° C. per second. This may be varied, however, depending on the temperature of the coal feed and the temperature of regenerated catalyst solids as well as the catalyst-to-coal ratio employed. Also, depending on the temperature, hydrogen pressure, and coal particle residence time in the reactor of the operation, considerable desulfurization and denitrogenation of the coal may be achieved, producing a relatively clean char. The coal particle-catalyst solids residence time in the reactor section is at least 2 seconds and may be as long as 30 seconds.

Any of the reactor configurations hereinbefore discussed may be employed to carry out the processing combination of this invention. The particular reactor configuration chosen will comprise the riser mixer and the downstream portion of the reaction will depend on the type of coal feed and on the products desired to be produced. The means used to separate volatiles and gas from the solids at the top of the riser-reactor 10 may include any suitable means known in the prior art such as, for example, cyclones alone or in combination with a bed of fluid solids at the riser discharge. The separated volatile and gaseous products are withdrawn from separation means 12 through line 14. If desired, some of the heavier, liquid product in stream 14 may be used to solvate the feed coal in line 1. Other separation schemes have been described above in connection with alternative embodiments useful in the present combination.

In the embodiment of FIG. 1, the catalyst with coke deposits of cracking and coal char residue pass from separation means 12 through line 17 to a regenerator 20 (also referred to herein as the gasification reactor). Separation means 12 may also be a form of elutriation which permits the forming of a char phase separate from primarily a catalyst phase so that each may be separately recovered therefrom. Thus, char may be separately recovered with catalyst particles alone or in combination with char particles being withdrawn by conduit 17 for passage to regeneration or a gasification zone. Char separately withdrawn from separation means 12 may be gasified in a separate gasification zone to particularly produce synthesis gas separately from catalyst regeneration flue gases (not shown in FIG. 1). Depending upon the quantity of coal converted in the riser, substantial quantities of carbon will enter the regenerator, imposing a substantial heat disposal load upon burning of the carbon char. However, when the catalyst employed is endowed with sufficient steam stability, the combined catalyst-char solids stream may be contacted with a mixture of an oxygen-containing gas and water (steam) through line 18 directly to the regenerator to produce, for example in the specific embodiment shown in FIG. 1, synthesis gas withdrawn through line 21. Heat generated by combustion of the carbon char and conversion of carbon to $H_2$ plus CO in one reaction zone all contribute to a general relief in the heat removal problem as compared when catalyst regeneration and steam gasification are performed in separate vessels. The gasification reaction occuring in regenerator 20 are well known and include the following:

(1) $C+2H_2O \rightarrow CO_2+2H_2$;
(2) $2C+1\frac{1}{2}O_2 \rightarrow CO_2+CO$;
(3) $CO_2+C \rightarrow 2CO$; and
(4) $CO+H_2O \rightarrow CO_2+H_2$.

Reactions (1) and (3) are endothermic reactions with reactions (2) and (4) being exothermic reactions. The temperature in the regenerator is maintained within the range from about 1300° to 1800° F. and preferably is sufficiently high to heat the catalyst up to about 1500° F. so that the regenerated catalyst may pass directly from regenerator 20 through line 22 to the bottom portion of riser-reactor 10 for admixture with coal particles as discussed above.

The maximum allowable temperature in the regenerator is normally dictated by the temperature stability of the catalyst and the fusion temperature of the ash obtained by burning the char; for example, Midwestern coal ash can be used safely up to ~2400° F. whereas Wyodak coal ash must be kept below 1800° F. Catalyst regeneration temperatures above 1600° F. are generally not desirable. Control of the temperature will prevent catalyst fouling or poisoning due to the ash minerals. In the case of acid catalysts, solid-solid ion exchange could be problematic even in non-fusing conditions. The ash will be composed primarily of very finely divided clays (~1μ), dolomite and pyrrhotite, some quartz or rutile crystals, and trace amounts of other metal oxides. The pyrrhotite can be finely dispersed or present as large crystals. Dolomite tends to be found as larger crystals. Pyrrhotite will be rapidly converted to $SO_2$ and $Fe_2O_3$ in the regeneration and dolomite to Ca-Mg oxides. All of these constituents are either finely divided to start with or are soft and will be attrited to fines by the moving catalyst. These fines will be carried upward out of the reactor by the product gases and will thus be separated from the recycle catalyst.

Figure 2:
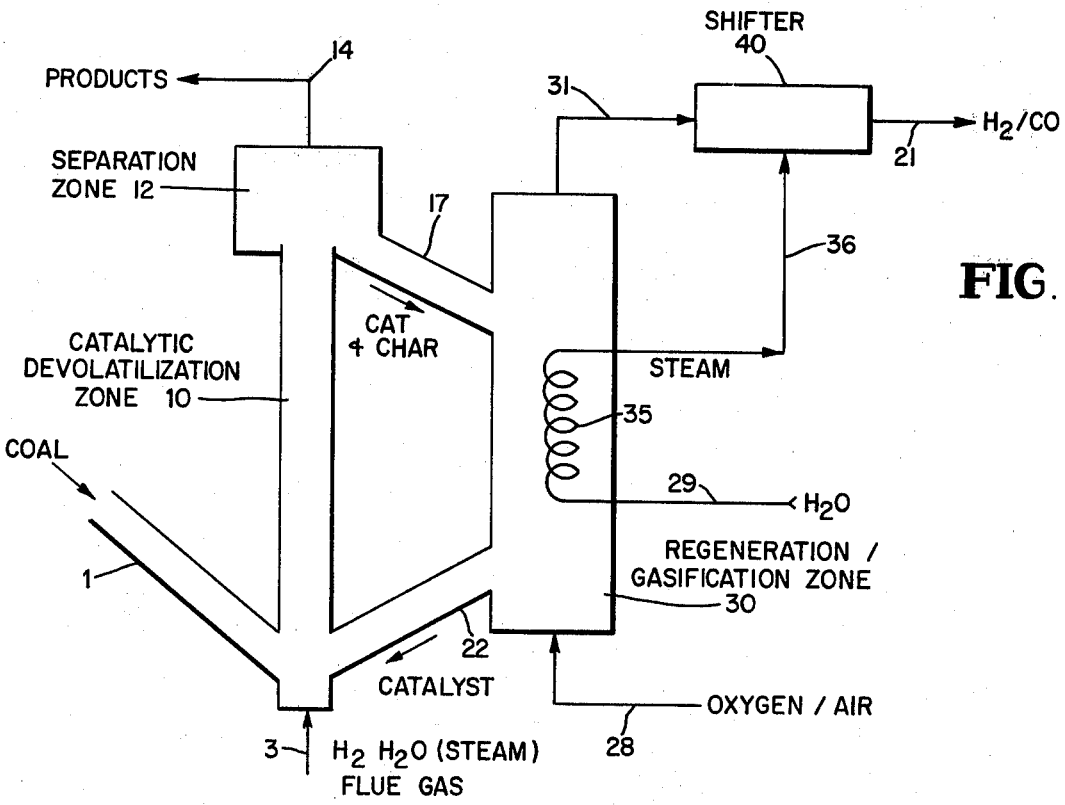
FIG. 2 is a schematic representation of an alternative embodiment of the process of this invention.

The laternative embodiment shown in FIG. 2 may be employed when there is a restriction because of temperature or steam limitations. This embodiment differs from that shown in FIG. 1 in that synthesis gas is generated in a zone other than the catalyst regeneration zone by reacting steam product of catalyst regeneration and char oxidation with the $CO/CO_2$ product withdrawn from the catalyst regeneration zone. Referring to FIG. 2, the catalyst and coal char residue pass from separation means 12 through line 17 to regenerator 30 which is provided with cooling coils 35 used to generate steam and immersed in a fluid bed of solids comprising catalyst being regenerated by burning char with an oxidizing gas (an oxygen-containing gas) entering via line 28 to produce $CO/CO_2$ flue gas. The presence of a significant amount of catalyst in the system (i.e., maintaining the catalyst-to-coal ratio within the range from about 0.5:1 to 5:1 facilitates maintaining a desired fluid bed of particle material during the combustion operation to form CO rich flue gases. Furthermore, processing the coal in the riser in the manner of this invention produces a product essentially free of tarry material. The regenerator 30 to which catalyst and char particles are passed is operated in partial combustion mode with oxygen-containing gas to produce a $CO/CO_2$ mixture rich in CO which is withdrawn via line 31 for passage to shifter 40. Water charged to the steam coils 35 via line 29 is converted to high temperature steam and removes enough heat from the regenerator to maintain the catalyst temperatures within the range from about 1300° to 1800° F. At least a portion of the steam produced in the fluid particle regeneration operation passes through line 36 to the shifter 40 or water gas shift reactor where the steam produced is reacted with the $CO/CO_2$ mixture passing thereto via line 31 to produce a synthesis gas mixture of hydrogen and $CO_2$ by the well-known shift reaction:

$$CO+H_2O \rightarrow CO_2+H_2.$$

The synthesis gas thus produced is recovered and withdrawn by line 21.

Alternatively, the char (all or a portion thereof) may be first separated from catalyst particles for subsequent use as fuel or other purposes and the regenerator 30 may be operated in a combustion mode producing $CO_2$ rich flue gas and the steam produced in the steam coils may be used for generating electric power.

In any of the foregoing embodiments, ash will normally be carried away from the regenerator/gasifier 20 (FIG. 1) or the regenerator 30 (FIG. 2) by the product gas and recovered in downstream separating means.

Addition of the combined catalyst-char mixture to the regenerator (FIG. 1) may not increase the gasifier diameter significantly since the superficial gas velocity employed in such an operation is the significant design parameter to be considered. For the same char reactivity, however, a deeper fluid particle bed is needed for the char/catalyst gasifier than for a bed gasifying char alone. Nevertheless, the presence of a more uniform particle size fluid catalyst may allow some increased gas velocities because of better fluid bed retaining characteristics. Improved char reactivity as herein obtained may be used to reduce the needed bed height for char gasification. Therefore, the dilution of the char inventory in the process combination of this invention need not necessarily increase the gasification investment requirements.

The use of a char gasifier (separate from the catalyst regenerator) in combination with the catalytic devolatilizer is an embodiment within the scope of this invention. The catalyst used in the method of this invention may be separated from the product vapors and coal char residue at the top of the riser reactor 10 by a number of different techniques known in the prior art. One arrangement is a density-related separation means. The separated catalyst is sent to a regenerator where its activity is partially or completely restored by combustion of carbon deposits and char accompanying the catalyst with air or oxygen-containing gas. The char residue/vapor mixture separated from the catalyst is then separated as by cyclones or other suitable separation means into a char phase and a gaseous-vapor material phase at the operating conditions. The char is then recovered for use as desired or a portion thereof is converted to synthesis gas via steam-air or steam-oxygen gasification. The separated gaseous-vapor phase comprising devolatilized product and conversion products thereof goes to product recovery.

Catalytic devolatilization of coal in a reactor system disclosed and according to the method and process of this invention has several advantages over known processes. First, it allows production of desirable hydrocarbon liquids together with selected gaseous product fractions at coal conversions within the range from about 10 to 30 weight percent. Second, the process allows for the production of relatively heavy, but storable, liquids containing little or no phenols. Third, devolatilized tarry material which is not partially or completely catalytically converted in the reactor arrangement deposits on the catalyst and char particles as relatively stable coke, coke which behaves well as discrete fluidizable particles in the regenerator of gasifier. Fourth, most of the devolatilized material is converted to more desirable fluid vaporous products (and some coke), and these products are kept separate from the gaseous products (i.e., synthesis gas) produced in the char gasifier or the catalyst regenerator/gasifier. Finally, even though some objectionable phenols may be produced, the overhead system does not contain or require much water. Consequently, the phenols can be separated at reasonable cost since they are concentrated.

The quality of the char residue produced by the herein-described catalytic devolatilization method is an important aspect of this invention. Furthermore, when the coal devolatilization step is combined with the subsequent separation steps, catalyst regeneration and char gasification, additional advantages in the invention combination are obtained as herein described. The char and catalyst mixture passed directly from the riser reactor (FIG. 1) to the regenerator/gasifier is an excellent material combination for effecting steam-oxygen or steam-air gasification of coke and char; such gasification produces high quality synthesis gas which in turn can be converted to premium hydrocarbons by further processing in systems such as Fischer-Tropsch synthesis or the Oxo process.

An important aspect of the combination is the desulfurization which will occur in the high-temperature coal devolatilization step—especially under hydrocarbonization conditions. Pyrite in the coal is very rapidly converted to $H_2S$ and pyrrhotite by elemental $H_2$. The resultant char will be lower in sulfur content than conventional carbonaceous feeds to gasification processes.

Having thus generally described the improved method and combination process of this invention and discussed preferred embodiments thereof, it is to be understood that no undue restrictions are to be imposed by reason thereof except as defined by the following claims.

What is claimed is:

1. An improved coal conversion process comprising:

(a) combining finely divided particulate coal particles preheated to a temperature within the range of from about 100° to 600° F., finely divided solid cracking catalyst particles heated to a temperature within the range of from about 1300° to 1800° F.—the ratio of catalyst to coal being within the range from about 0.5:1 to 5:1, and a suspension-forming gaseous material whereby the coal particles are rapidly heated to a temperature within the range of from about 750° to 1650° F.;

(b) passing the suspension thus formed through a reactor arrangement providing a coal particle residence time within the range of from about 2 to 30 seconds;

(c) separating and recovering volatile products and gases from the solids following traverse of said reactor arrangement.

2. The process of claim 1 wherein the suspension-forming gaseous material is selected from the group comprising steam, hydrogen-containing gas, flue gas, and mixtures thereof.

3. The process of claim 1 wherein the suspension-forming gaseous material is a hydrogen-containing gas and the hydrogen pressure in the reactor arrangement is less than 500 psig.

4. The process of claim 3 wherein the hydrogen pressure is less than 250 psig.

5. The process of claim 3 wherein the hydrogen-containing gas is synthesis gas.

6. The process of claim 1 wherein the cracking catalyst is selected from the group comprising amorphous and crystalline, silica-alumina-containing catalysts.

7. The process of claim 1 wherein the catalyst is a low activity silica-alumina containing catalyst.

8. The process of claim 1 wherein the coal particles are rapidly heated to a temperature within the range of from about 750° to 1200° F.

9. The process of claim 1 wherein the coal particles are rapidly heated to a temperature within the range of from about 800° to 1100° F.

10. The process of claim 1 wherein the solids separated from the reactor arrangement, comprising a char product of coal devolatilization and catalyst solids, are passed to a regeneration/gasification zone wherein regeneration of catalyst particulate and char product gasification is accomplished with steam and an oxygen-containing gas.

11. The process of claim 1 wherein the suspension comprises coal particles less than 8 mesh and the catalyst particles are within the range of 8 to 400 mesh.

12. The process of claim 11 wherein said catalyst particles are generally larger than said coal particles.

13. The process of claim 12 wherein the solids separated from the reactor arrangement, comprising a char product of coal devolatilization and catalyst particles, are separated substantially from one another, regeneration of catalyst particles is accomplished in a zone separate from gasification of char particles, and gaseous material suitable for use as suspension forming gaseous material is obtained as a product thereof.

14. The process of claim 13 wherein steam is generated in said catalyst regeneration operation, the steam thus produced is used in said char gasification operation to form synthesis gas, and generated synthesis gas is used in said reactor arrangement to form a suspension of said coal and catalyst particles.

15. The process of claim 13 wherein about 90 percent of said catalyst particles are larger than about 60 mesh and about 90 percent of said coal particles are smaller than about 60 mesh.

16. The process of claim 1 wherein the temperature rise of the coal particles is about 600° C. per second.

17. The process of claim 1 wherein the suspension is initially formed in a riser contact zone and the hot suspension with devolatilized material is passed through one of a riser reactor or a dense fluid bed of particles to obtain additional desired coal-volatiles residence time before separating catalyst and char particles from gasiform material comprising gases and volatiles formed in the reactor zone.

18. The process of claim 1 wherein the separated solids are passed to a separate zone maintained at a temperature within the range of 1300° to 1800° F. wherein the solids are contacted with an oxygen-containing gas.

19. An improved coal conversion process comprising (a) combining particulate coal preheated to a temperature within the range from about 100° to 600° F. and a recirculating, finely-divided solid cracking catalyst having a temperature within the range from about 1300° to 1800° F., the ratio of coal to catalyst being within the range from about 0.5:1 to 5:1, in a high-velocity stream of propelling gas selected from the group consisting of steam, hydrogen-containing gas, flue gas, and mixtures thereof, whereby the coal is rapidly heated to a temperature within the range from about 750° to 1650° F.;

(b) passing the combined high-velocity steam through a reactor arrangement wherein the coal residence time is within the range from about 2 to 30 seconds.

(c) separating the evolved volatile products and gases from the solids portion of the combined high-velocity stream;

(d) gasifying and regenerating the separated solids portion with a mixture of an oxygen-containing gas and stream in a fluidized bed reactor to produce synthesis gas and regenerated catalyst;

(e) recovering the synthesis gas; and (f) returning the regenerated catalyst to combine with particulate coal in said reactor arrangement;

20. The process of claim 19 wherein the temperature in the fluidized bed reactor is maintained within the range from about 1300° to 1800° F.

21. The process of claim 19 wherein the propelling gas is a hydrogen-containing gas and the hydrogen pressure in the riser reactor is less than 500 psig.

22. The process of claim 21 wherein the hydrogen-containing gas is synthesis gas.

23. The process of claim 19 wherein the catalyst is a used silica-alumina catalyst.

24. An improved coal conversion process comprising:

(a) combining particulate coal preheated to a temperature within the range from about 100° to 600° F. and a recirculating finely-divided solid cracking catalyst having a temperature within the range from about 1300° to 1800° F., the ratio of coal to catalyst being within the range from about 0.5:1 to 5:1, in a high-velocity stream of propelling gas selected from the group consisting of steam, hydrogen-containing gas, flue gas, and mixtures thereof, whereby the coal is rapidly heated to a temperature within the range from about 750° to 1650° F.;

(b) passing the combined high-velocity stream through a reactor arrangement wherein the coal residence time is within the range from about 2 to 30 seconds;

(c) separating the evolved volatile products and gases from the solids portion of the combined high-velocity stream;

(d) gasifying and regenerating the separated solids portion with an oxygen-containing gas in a fluidized bed reactor operated in the partial combustion mode and introducing water into steam coils immersed in the fluidized bed, thereby maintaining the temperature in the reactor within the range from about 1300° to 1800° F., to produce a gaseous mixture containing CO and $CO_2$, regenerated catalyst, and steam;

(e) returning the regenerated catalyst to combine with particulate coal in said reactor arrangement; and (f) contacting the gaseous mixture containing CO and $CO_2$ with at least a portion of the steam generated in a shift reactor to produce synthesis gas.

25. An improved coal conversion process comprising:

(a) combining particulate coal preheated to a temperature within the range from about 100° to 600° F. and a recirculating, finely-divided solid cracking catalyst having a temperature within the range from about 1300° to 1800° F., the catalyst particles having a particle diameter generally larger than said particulate coal and the ratio of coal to catalyst being within the range from about 0.5:1 to 5:1, in a high velocity stream of propelling gas selected from the group consisting of steam, hydrogen-containing gas, flue gas, and mixtures thereof, whereby the coal is rapidly heated to a temperature within the range from about 750° to 1650° F.;

(b) passing the combined high-velocity stream through a reactor arrangement wherein the coal residence time is within the range from about 2 to 30 seconds;

(c) separating the evolved volatile products and gases and coal char residue from the catalyst;

(d) regenerating the catalyst by at least partial combustion with an oxygen-containing gas and returning the regenerated catalyst to combine with particulate coal in the riser reactor;

(e) separating the evolved volatile products and gases from the coal char residue; and (f) gasifying the separated coal char residue with a mixture of an oxygen-containing gas and steam in a fluidized bed reactor to produce synthesis gas.

* * * * *